US008750769B2

(12) United States Patent
Cleary et al.

(10) Patent No.: US 8,750,769 B2
(45) Date of Patent: Jun. 10, 2014

(54) INFERRING TONER CONTAMINATION OF ELECTRODES FROM PRINTING PARAMETERS

(75) Inventors: Michele D. Cleary, Rochester, NY (US); James A. Winters, Alfred Station, NY (US); James P. Kitchen, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 13/453,052

(22) Filed: Apr. 23, 2012

(65) Prior Publication Data

US 2013/0279929 A1 Oct. 24, 2013

(51) Int. Cl.
*G03G 15/08* (2006.01)

(52) U.S. Cl.
CPC .... *G03G 15/0803* (2013.01); *G03G 2215/0621* (2013.01); *G03G 2215/0643* (2013.01)
USPC ..... 399/291; 399/31; 399/99

(58) Field of Classification Search
CPC ..... G03G 15/0803; G03G 2215/0643; G03G 15/0621
USPC ..... 399/31, 99, 290, 291
See application file for complete search history.

(56) References Cited

U.S. PATENT DOCUMENTS

| | | | | |
|---|---|---|---|---|
| 3,545,378 | A | 12/1970 | Childress | |
| 4,106,409 | A | 8/1978 | Kobayashi et al. | |
| 4,755,837 | A | 7/1988 | Schmidlin et al. | |
| 5,010,367 | A | 4/1991 | Hays | |
| 5,311,258 | A * | 5/1994 | Brewington et al. | 399/266 |
| 5,633,110 | A | 5/1997 | Desie et al. | |
| 5,734,954 | A * | 3/1998 | Eklund et al. | 399/266 |
| 6,032,004 | A | 2/2000 | Mirabella, Jr. et al. | |
| 6,049,686 | A * | 4/2000 | Folkins et al. | 399/266 |
| 6,205,303 | B1 * | 3/2001 | Fujii et al. | 399/100 |
| 6,578,478 | B2 | 6/2003 | Doppler | |

* cited by examiner

*Primary Examiner* — Walter L Lindsay, Jr.
*Assistant Examiner* — Benjamin Schmitt
(74) *Attorney, Agent, or Firm* — Gibb & Riley, LLC

(57) ABSTRACT

A computer implemented method of cleaning electrodes (such as wires) is used in a toner-based electrostatic printing device. The electrodes produce an environment containing charged toner particles to assist in electrostatic printing. The method automatically monitors at least two printing parameters that are unrelated to signals and voltages provided to the electrodes (using a processor of the electrostatic printing device). Further, this method also uses the processor automatically infers a toner contamination of the electrodes from the printing parameters. This allows the processor to automatically adjust the printing the used by the electrostatic printing device during electrostatic printing to maintain the contamination of the electrodes below a threshold.

20 Claims, 4 Drawing Sheets

INFERRING TONER CONTAMINATION OF ELECTRODES FROM PRINTING PARAMETERS

BACKGROUND

Embodiments herein generally relate to printing devices and more particularly to printing devices that use wires or other toner charging devices used to create a cloud of toner during the printing process.

Development housings within electrostatic printing devices can use AC and DC biased wires to launch a toner cloud for non-contact development to a photoreceptor (PR). However, in such systems the wires can sometimes become polluted with toner constituents, thereby decreasing the effectiveness of the cloud.

Some methods of managing wire pollution are based on non-nominal fleet operation data, in which wire cleaning set points are selected based on average or worst-case wire pollution stress conditions. These set points may not be optimal for the non-stress conditions, and the performance of cleaning operations on printing devices that experience non-stress conditions can be wasteful.

For example, a wire cleaning cycle can be performed, which involves pressing the wire against the donor roll to remove pollution on the wire. This can be run at cycle up and cycle down. This routine is used to change the charge and shake the wire, and is a successful method of removing the toner build-up on the wire. This is not currently performed during printing run, because it would cause sudden color shifts during the run. This wire cleaning cycle can cause huge transients in development and causes color shifts if run infrequently. Therefore, this is not a good solution to wire pollution if performed infrequently or mid-job. This method also adds stress to the wire.

Also, a periodic toner purging can be preformed during a "deadcycle" (time of non-usage of a printing device) to decrease toner age and reduce wire contamination. For example, the periodic toner purge can be preformed on every machine in every condition when toner age reaches a threshold. However, for printing machines that are not experiencing wire contamination, this fleet-wide toner purge process can waste time, electricity, and toner. Further, a minimum area coverage (MAC) patch can be used to slow the rate of toner aging in the sump, to reduce wire contamination. Again however, this treats all machines in a fleet equally when it comes to managing toner age, and can be wasteful on printing machines that are not experiencing wire contamination.

SUMMARY

An exemplary computer implemented method of cleaning electrodes in a toner-based electrostatic printing device is presented below. The electrodes can comprise, for example, exposed wires conducting alternating current (AC) and direct current (DC) and produce an environment containing charged toner particles to assist in electrostatic printing. This exemplary method automatically monitors at least two printing parameters that are unrelated to signals and voltages provided to the electrodes (using a processor of the electrostatic printing device). The printing parameters can include, for example, magnetic brush bias amount, laser power level, cleaning field charge, environment measurements, toner age, carrier age, degree of printing non-uniformity, etc.

Further, this method also uses the processor to automatically infer a toner contamination level of the electrodes from the printing parameters. This allows the processor to automatically adjust the printing settings used by the electrostatic printing device during electrostatic printing to maintain the contamination of the electrodes below a threshold. The printing settings can include, for example, changing an amount of toner dispensed, changing an amount of carrier dispensed, and changing a set point adjustment of automated toner purge routines. Thus, methods herein can perform automated cleaning routines of the electrodes based only upon the contamination inferred by the processor.

An exemplary printing device includes a printing engine and electrodes in the printing engine. The electrodes produce an environment containing charged toner particles in the printing engine. Further, other printing elements in the printing engine have printing parameters that are unrelated to the electrodes. This exemplary device also includes a processor operatively connected to the printing engine. The processor automatically infers a contamination level of the electrodes from the printing parameters of the other printing elements. Further, the processor automatically adjusts the printing elements during printing to maintain the contamination of the electrodes below a threshold.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
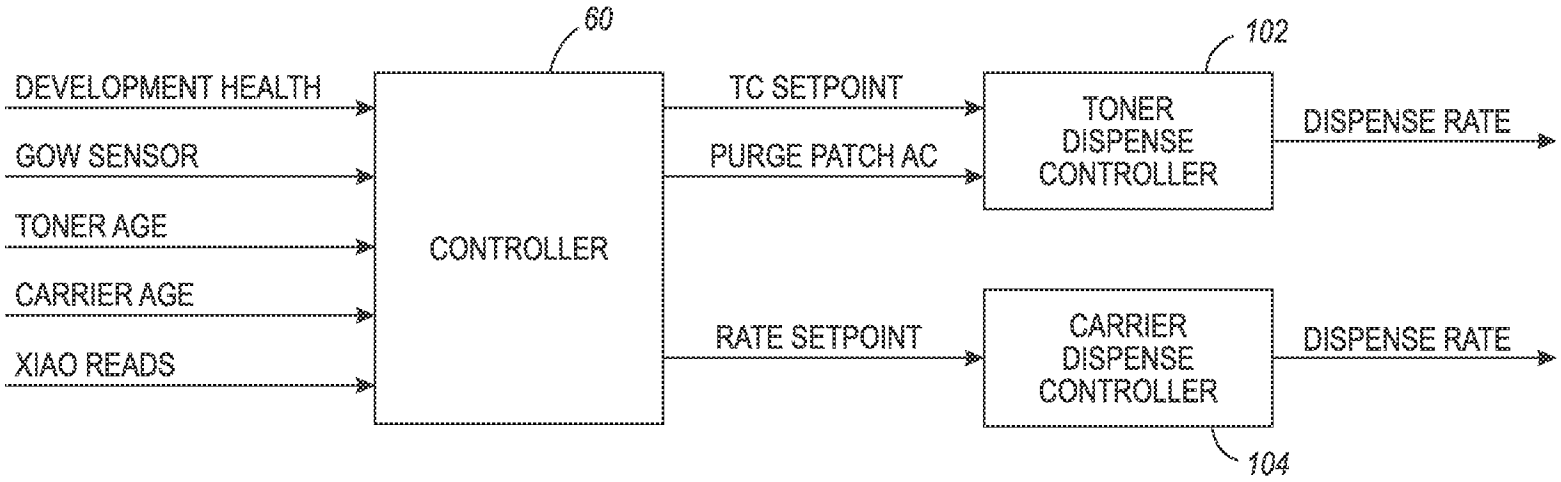
FIG. 1 is a schematic diagram of elements a device according to embodiments herein.

As mentioned above, wire cleaning operations may not be optimal for the printing devices that experience non-stress conditions, and the performance of fleet-wide mandated cleaning operations on printing devices that experience non-stress conditions can be wasteful. Therefore, as shown in FIG. 1, the devices and methods herein infer a toner contamination of the toner electrodes (sometimes referred to herein as "wires") from the printing parameters using a main controller/processor 60 (also shown in FIG. 5, discussed below). This allows the processor 60 to automatically adjust the printing settings used by the electrostatic printing device during electrostatic printing to maintain the contamination of the electrodes below a threshold. Thus, the printing devices and methods described herein manipulate the toner dispense 102, carrier dispense 104, and toner purge set point of a high speed draft (HSD) electrostatic type development housing in a smart fashion to minimize wire pollution.

Fresh toner dispense by the toner dispense controller 102 as well as carrier dispense by the carrier dispense controller 104 are significant drivers with respect to decreasing wire pollution. Therefore, the methods and systems herein use a series of control methods to regulate the toner dispense controller 102, carrier dispense controller 104, and the toner purge set point (maintained by main controller 60) in an efficient, smart fashion, to maintain minimal wire pollution while simultaneously maintaining optimum costs relative to toner usage and carrier usage that is customized for each individual printing machine.

As shown in FIG. 1, the systems development health is inferred herein by a series of actuators such as magnetic brush bias, laser power, cleaning field, etc. Development health along with other measurements such as environment measurements grains of water (GOW (an absolute humidity measure)), toner age calculations, and carrier age calculation, along with degree of non uniformity can be a good indicator of the degree of wire pollution. In the event that the controller 60 determines the presence of wire pollution given the current combination of inputs, the controller triggers the toner dispense controller 102 to change the amount of toner dispensed, the carrier dispense controller 104 to change the amount of carrier dispensed, and/or the controller 60 to adjust the toner purge set point.

When adjusting the toner dispense controller 102, the main controller 60 balances the additional toner dispense by correspondingly adjusting the AC supplied to perform a purge patch, so that the desired toner concentration (TC) target is maintained. By allowing for a variable purge AC or area coverage printed in the inter-document zone, the system has the necessary degrees of freedom to control the dispense process independently of toner concentration. In an extreme scenario where the controller 60 has calculated a desired dispense amount that is greater than the image output terminal (IOT (printing module)) is capable of printing with purge patch AC, the system will choose to perform deadcycle cleaning process. However, given that the carrier dispense is also a very capable actuator with respect to the reduction of wire pollution, the instances of the deadcycle will be less than without carrier dispense used as an actuator. The carrier dispense can be allowed to actuate to the maximum amount the system can manage.

Figure 2:
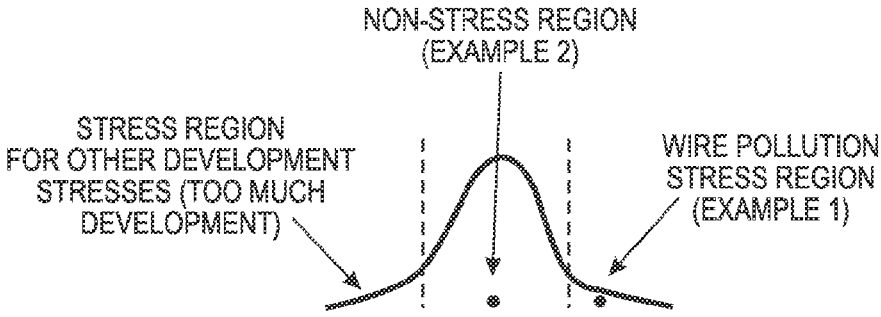
FIG. 2 is a chart illustrating features according to embodiments herein.

FIG. 2 illustrates two examples of how the embodiments herein decrease costs by reducing the amount of wire cleanings performed, and only perform wire cleaning if a specific device needs cleaning. For example, if the portion of a printing fleet has more latitude to allow higher toner age and carrier age, these machines adapt to higher carrier age and toner age numbers as allowed by the controller 60. This produces cost savings to the fleet while still maintaining print quality. Alternatively, if a portion of the fleet is in extreme stress conditions for wire pollution, the controller 60 will change toner and carrier purge cycle times to lower carrier age and toner age. Thus, these machines will dip into the banked savings produced by non-stressed machines in the fleet (that use less toner and carrier) and spend more on toner and carrier in stressed machines of the fleet, to maintain the same print quality. Thus, FIG. 2 shows that the stressed portion of the fleet that suffers excessive wire pollution is a small part of the fleet. Further, the stress experienced by other fleet machines is small (and this portion of the fleet is much larger). Therefore, while toner and carrier costs may increase for a small portion of a fleet, toner and carrier costs for the larger non-stressed portion of the fleet is decreased, which decreases costs for the fleet as a whole. This significantly improves the wire pollution issue, and insures optimum printing quality across the fleet by reducing variability. Further, costly hardware changes (such as wire spinner replacement) are reduced or avoided.

Figure 3:
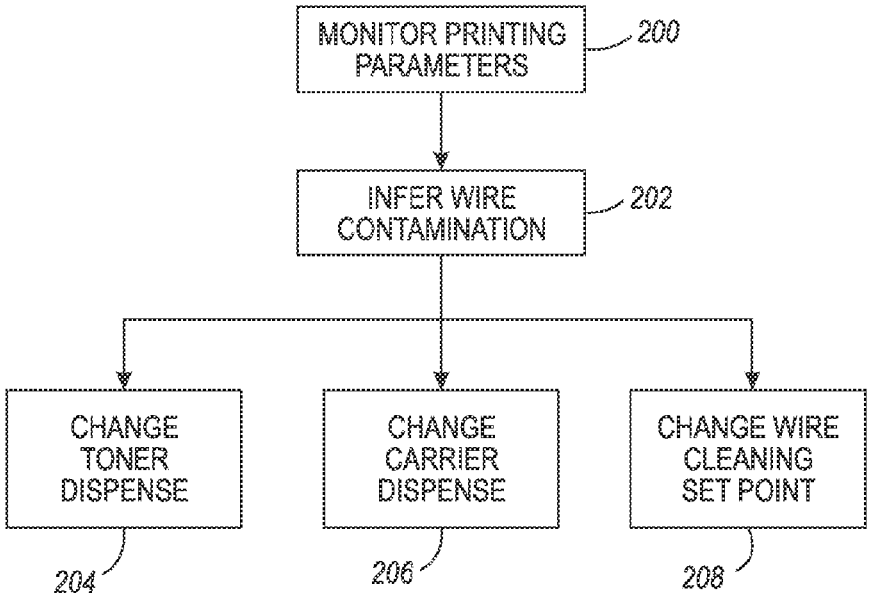
FIG. 3 is a flowchart illustrating features according to embodiments herein.

FIG. 3 is flowchart illustrating an exemplary method of cleaning electrodes in a toner-based electrostatic printing device herein. The electrodes can comprise, for example, exposed wires conducting alternating current (AC) and direct current (DC) and produce an environment containing charged toner particles to assist in electrostatic printing In item 200, this exemplary method automatically monitors at least two printing parameters that are unrelated to signals and voltages provided to the electrodes (using a processor of the electrostatic printing device). The printing parameters can include, for example, magnetic brush bias amount, laser power level, cleaning field charge, environment measurements, toner age, carrier age, degree of printing non-uniformity, etc.

Further, in item 202, this method also uses the processor to automatically infer a toner contamination of the electrodes from the printing parameters. This allows the processor to automatically adjust the printing settings used by the electrostatic printing device during electrostatic printing to maintain the contamination of the electrodes below a threshold. The printing settings can include, for example, changing an amount of toner dispensed 204, changing an amount of carrier dispensed 206, and changing a set point adjustment of automated toner purge routines 208. Therefore, the methods herein only perform automated cleaning routines of the electrodes in item 208 based upon the contamination inferred by the processor.

Figure 4:
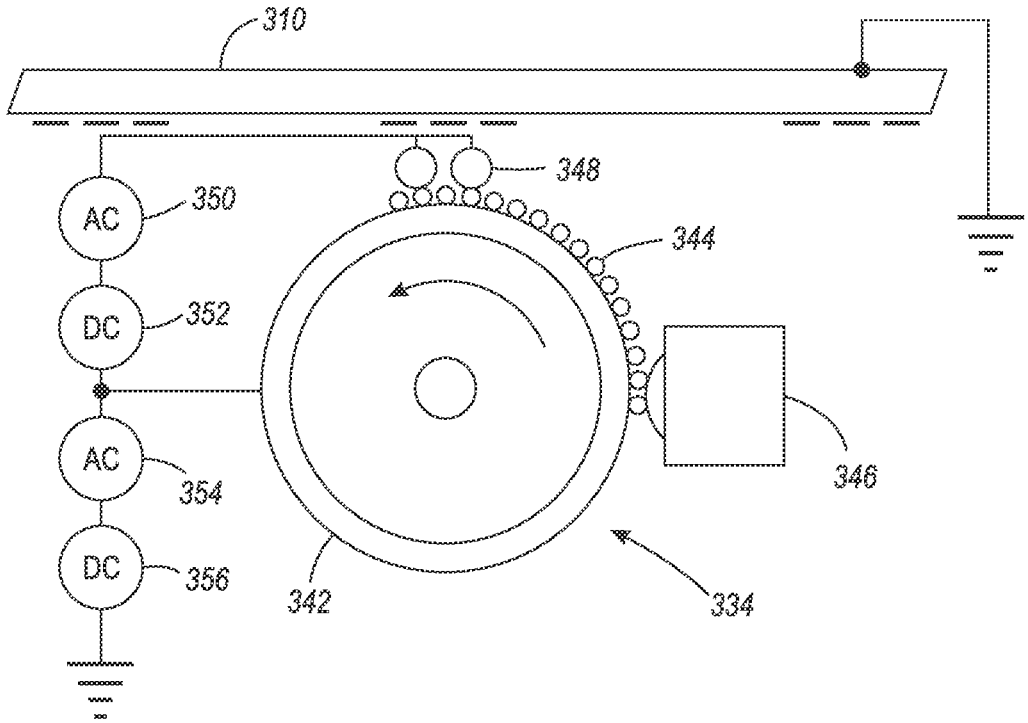
FIG. 4 is a side-view schematic diagram of a device according to embodiments herein.

FIG. 4 illustrates a photoreceptor 310, a developer apparatus 334 that includes a charging device 346, developer 344, and an electrode structure 348. In FIG. 4, an altering electrical bias that is applied to the electrode structure 348 via an AC voltage source 350. The applied AC establishes an alternating electrostatic field between the wires and the donor structure which is effective in detaching toner from the surface of the donor structure and forming a toner cloud intermediate the donor structure 342 and the charge retentive surface. The magnitude of the AC voltage can be, for example, relatively low (e.g., 200 to 300 volts peak at a frequency of about 4 kHz up to 10 kHz). A DC bias supply 352 applies approximately 0 to 50 volts on the wires 348 relative to the donor structure 342. At a spacing of approximately 25 μm between the electrode and donor structures, an exemplary applied voltage of 200 to 300 volts produces a relatively large electrostatic field without risk of air breakdown.

The use of a dielectric coating on either of the structures helps to prevent shorting of the applied AC voltage. The field strength produced can be, for example, on the order of 8 to 16 volts/μm. Once formed, the toner cloud's proximity to the image receiving surface is controlled by the application of an AC/DC bias voltage applied between the donor roll/wire electrode assembly and ground via AC source 354 and DC source 356. With an AC bias of approximately 270 volts applied to the wires as noted above, an AC bias at a frequency of 4 to 10 kHz is applied via the source 354. Simultaneously, a DC bias if approximately 600 volts is applied via the source 356 for establishing a development field between the donor and the image receiver such that the charged area development (CAD) is effected.

Figure 5:
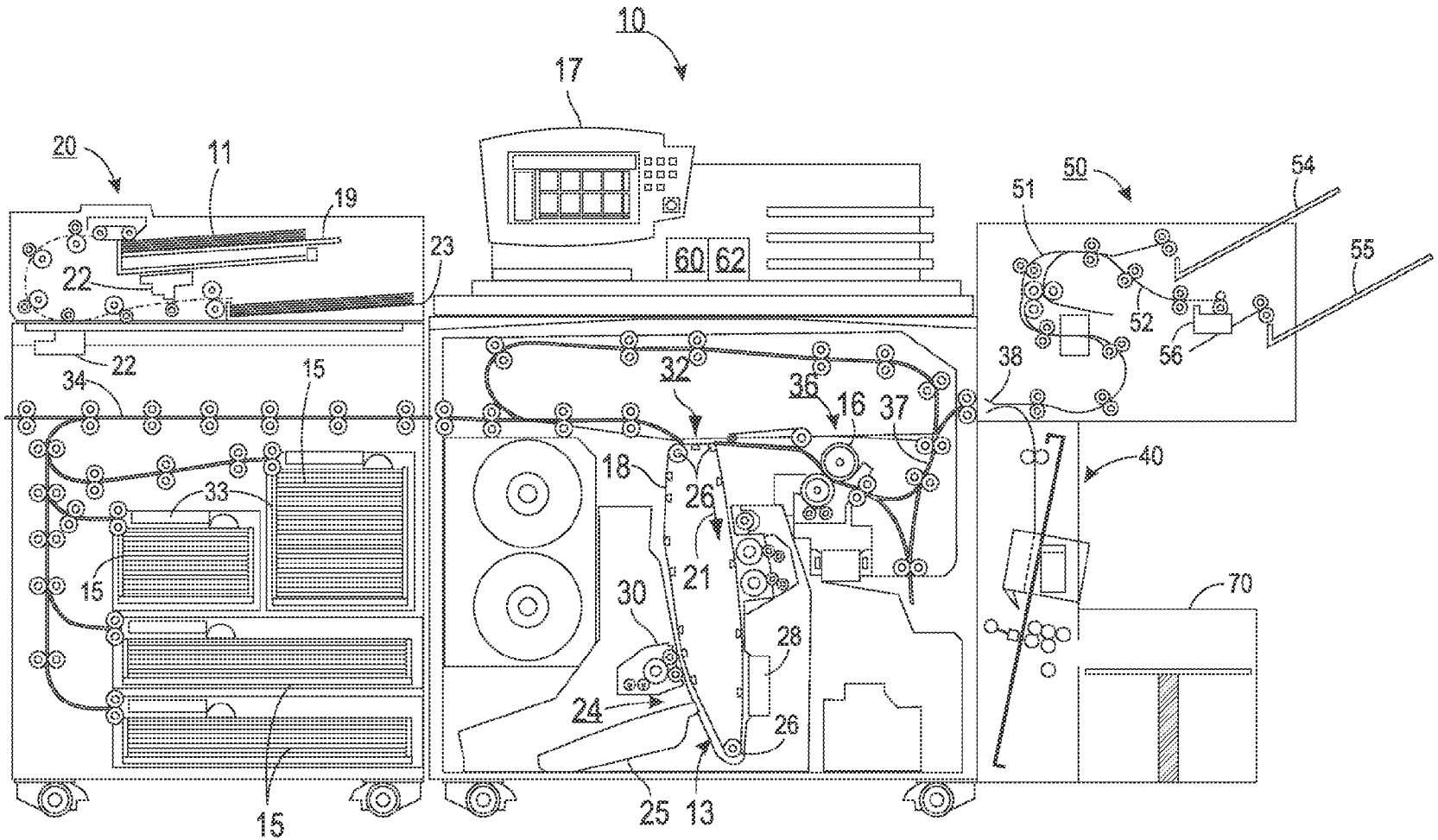
FIG. 5 is a side-view schematic diagram of a device according to embodiments herein.

The overall printing device in which such a structure is included is shown in FIG. 5. More specifically, in FIG. 5 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling.

As would be understood by those ordinarily skilled in the art, the printing device 10 shown in FIG. 5 is only one example and the embodiments herein are equally applicable to other types of printing devices that may include fewer components or more components. For example, while a limited number of printing engines and paper paths are illustrated in FIG. 5 those ordinarily skilled in the art would understand that many more paper paths and additional printing engines could be included within any printing device used with embodiments herein.

In such a computerized (printing) device 10, the electrodes 48 produce an environment containing charged toner particles in the printing engine 32. Further, other printing elements in the printing engine 32 have printing parameters that are unrelated to the electrodes 48. The processor 60 automatically infers a contamination of the electrodes 48 from the printing parameters of the other printing elements 32. Further, the processor 60 automatically adjusts printing settings of the printing elements 32 during printing (e.g., changing the amount of toner dispensed, changing the amount of carrier dispensed, and changing the set point adjustment of automated toner purge routines) to maintain the contamination of the electrodes 48 below a threshold.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A computer implemented method of cleaning electrodes in a printing device, said method comprising:

automatically monitoring at least two printing parameters that are unrelated to signals and voltages provided to said electrodes using a processor of said printing device, said at least two printing parameters comprising bias amounts and power levels of actuators of said printing device;

automatically inferring a contamination of said electrodes from said at least two printing parameters using said processor; and automatically adjusting printing settings used by said printing device during printing using said processor to maintain said contamination of said electrodes below a threshold.

2. The computer implemented method according to claim 1, further comprising automatically performing automated cleaning routines based only upon said contamination inferred by said processor.

3. The computer implemented method according to claim 1, said printing parameters comprising at least one of: magnetic brush bias amount, laser power level, and degree of printing non-uniformity.

4. The computer implemented method according to claim 1, said printing settings comprising at least one of: changing an amount of toner dispensed, changing an amount of carrier dispensed, and changing a set point adjustment of automated toner purge routines.

5. The computer implemented method according to claim 1, said electrodes comprising exposed wires conducting one of alternating current (AC) and direct current (DC).

6. A computer implemented method of cleaning electrodes in a toner-based electrostatic printing device, said electrodes producing an environment containing charged toner particles, said method comprising:

automatically monitoring at least two printing parameters that are unrelated to signals and voltages provided to said electrodes using a processor of said electrostatic printing device, said at least two printing parameters comprising bias amounts and power levels of actuators of said printing device;

automatically inferring a toner contamination of said electrodes from said at least two printing parameters using said processor; and automatically adjusting printing settings used by said electrostatic printing device during electrostatic printing using said processor to maintain said contamination of said electrodes below a threshold.

7. The computer implemented method according to claim 6, further comprising automatically performing automated cleaning routines based only upon said contamination inferred by said processor.

8. The computer implemented method according to claim 6, said printing parameters comprising at least one of: magnetic brush bias amount, laser power level, and degree of printing non-uniformity.

9. The computer implemented method according to claim 6, said printing settings comprising at least one of: changing an amount of toner dispensed, changing an amount of carrier dispensed, and changing a set point adjustment of automated toner purge routines.

10. The computer implemented method according to claim 6, said electrodes comprising exposed wires conducting one of alternating current (AC) and direct current (DC).

11. A printing device comprising:

a printing engine;

electrodes in said printing engine, said electrodes producing an environment containing charged toner particles;

printing elements in said printing engine, said printing elements having at least two printing parameters that are unrelated to signals and voltages provided to said electrodes, said at least two printing parameters comprising bias amounts and power levels of actuators of said printing device; and a processor operatively connected to said printing engine, said processor automatically inferring a contamination of said electrodes from said at least two printing parameters of said printing elements, and said processor automatically adjusting printing settings of said printing elements during printing to maintain said contamination of said electrodes below a threshold.

12. The printing device according to claim 11, said processor automatically performing automated cleaning routines based only upon said contamination inferred by said processor.

13. The printing device according to claim 11, said at least two printing parameters comprising at least one of: magnetic brush bias amount, laser power level, and degree of printing non-uniformity.

14. The printing device according to claim 11, said printing settings comprising at least one of: changing an amount of toner dispensed, changing an amount of carrier dispensed, and changing a set point adjustment of automated toner purge routines.

15. The printing device according to claim 11, said electrodes comprising exposed wires conducting one of alternating current (AC) and direct current (DC).

16. A non-volatile computer storage medium readable by a computerized device, said non-volatile computer storage medium storing instructions executable by said computerized device to perform a method of cleaning electrodes in a printing device comprising:

automatically monitoring at least two printing parameters that are unrelated to signals and voltages provided to said electrodes, said at least two printing parameters comprising bias amounts and power levels of actuators of said printing device;

automatically inferring a contamination of said electrodes from said at least two printing parameters; and automatically adjusting printing settings used by said printing device during printing to maintain said contamination of said electrodes below a threshold.

17. The non-volatile computer storage medium according to claim 16, said method further comprising automatically performing automated cleaning routines based only upon said contamination.

18. The non-volatile computer storage medium according to claim 16, said printing parameters comprising at least one of: magnetic brush bias amount, laser power level, and degree of printing non-uniformity.

19. The non-volatile computer storage medium according to claim 16, said printing settings comprising at least one of: changing an amount of toner dispensed, changing an amount of carrier dispensed, and changing a set point adjustment of automated toner purge routines.

20. The non-volatile computer storage medium according to claim 16, said electrodes comprising exposed wires conducting one of alternating current (AC) and direct current (DC).

* * * * *